United States Patent [19]

Froh

[11] Patent Number: 4,610,065

[45] Date of Patent: Sep. 9, 1986

[54] SICKLE KNIFE REPLACEMENT ASSEMBLY

[76] Inventor: John Froh, Box 142, Khedive, Saskatchewan, Canada, S0C 1K0

[21] Appl. No.: 823,380

[22] Filed: Jan. 28, 1986

[30] Foreign Application Priority Data

Feb. 5, 1985 [CA] Canada ..... 473,637

[51] Int. Cl.[4] ..... B23P 11/00

[52] U.S. Cl. ..... 29/243.53; 29/251; 29/252; 29/402.08; 29/426.4; 29/426.5

[58] Field of Search ..... 29/402.08, 426.4, 426.5, 29/251, 252, 243.53; 59/7, 11; 225/103, 93

[56] References Cited

U.S. PATENT DOCUMENTS

| | | | |
|---|---|---|---|
| 1,544,393 | 6/1925 | Hatcher et al. | 29/251 |
| 4,293,991 | 10/1981 | Bailey | 29/252 |
| 4,506,501 | 3/1985 | DeVall et al. | 29/251 |
| 4,512,070 | 4/1985 | Anhalt | 29/243.53 |

*Primary Examiner*—Robert C. Watson
*Attorney, Agent, or Firm*—Stanley G. Ade

[57] ABSTRACT

Conventionally, rivets are sheared off by hand whereupon a rivet shank removal tool is engaged around the knife and align so that the punch aligns with the rivet shank. A nut is then tightened with a wrench thus pushing the rivet shank out of the hole and when all rivets have been removed, the old knife can be removed also. A new knife is then positioned upon the cutter bar, rivets are installed and the heads riveted over, a labor intensive, time consuming operation. With the present device, the knife assembly is engaged across a portable frame carrying a tool group and one end of the knife assembly is engaged between manually operated rollers so that it can be adjusted lengthwise to place the knife being replaced, successively in the correct position with a shear tool which shears off the knife and rivets heads, a punching tool to remove the shanks and a riveting tool to rivet over the heads of rivets holding a new knife in position. All of these tools are hydraulic or pneumatically operated.

20 Claims, 6 Drawing Figures

SICKLE KNIFE REPLACEMENT ASSEMBLY

BACKGROUND OF THE INVENTION

This invention relates to new and useful improvements in apparatus and a method of replacing individual knives upon a knife bar.

These knife bars are well known and are used in combines, swathers and other haying equipment. The individual knives are riveted to a knife bar which is reciprocated between guards in order to cut the grain or hay.

As may be appreciated, individual knives wear in a period of time, become damaged or broken and have to be replaced.

Conventionally, this has been done manually and individually by chiseling off the rivet heads holding the knife to the bar, then punching out the remaining portions of the rivets by attaching a manually operated rivet removal tool, attaching the new knife in position by means of new rivets and then heading over these rivets in order to secure the knife to the bar.

As will be appreciated, this is an extremely time consuming and labour intensive operation and holds up field operations if such sections have to be replaced during use rather then during general maintenance at a time when the machine is not being used.

SUMMARY OF THE INVENTION

The present invention overcomes these disadvantages by providing an assembly in which the knife bar carrying the knives can be moved readily and easily between stations on a supporting frame with the first station utilizing a pneumatic or hydraulically operated shearing device which shears the knife from the bar, a second station which provides a pneumatically or hydraulically operated punch assembly for removing the sheared rivets from the bar, and a third station which includes a pneumatically or hydraulically operated riveting device which heads over the rivets holding the new knife portion in position.

In accordance with the invention there is therefore provided an assembly for removing and replacing sickle knives on a knife bar comprising in combination a supporting frame, first means on said frame to shear the rivets securing individual knives to said knife bar and to remove the knife therefrom, second means on said frame to punch out the rivet shanks from said knife bar remaining after said knife has been sheared therefrom, and third means on said frame to rivet new knives in position upon said frame, said first, second and third means operating successively upon individual knives being replaced, means to operate selectively, said first, second and third means and further means on said frame to position said knife bar successively relative to said first, second and third means.

In accordance with a further advantage of the invention there is provided a method of replacing individual sickle knives upon a knife bar consisting of the steps of first detachably holding the bar for selective positioning of same longitudinally relative to an assembly, an assembly having first, second and third stations thereon, positioning a portion of said bar at said first station and shearing off the individual knife on said portion, from said bar, moving said portion of said bar to said second station and punching out rivet shanks left in said bar after said individual knife has been sheared therefrom, and then moving said portion of said bar to said third station, engaging a new knife upon said bar, engaging rivets through said bar and said new knife and then heading said rivets.

The device is mounted in a support frame which is preferably mounted on rollers so that it is portable and it includes means to hold the bar in position and to move same lengthwise so that the knife section being replaced can be positioned at any one of the three stations as desired.

A further advantage of the invention is to provide a device of a character herewithin described which enables knife sections to be replaced readily and easily and with a considerable saving in time and labour over conventional methods.

A further advantage of the invention is to provide a device of a character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
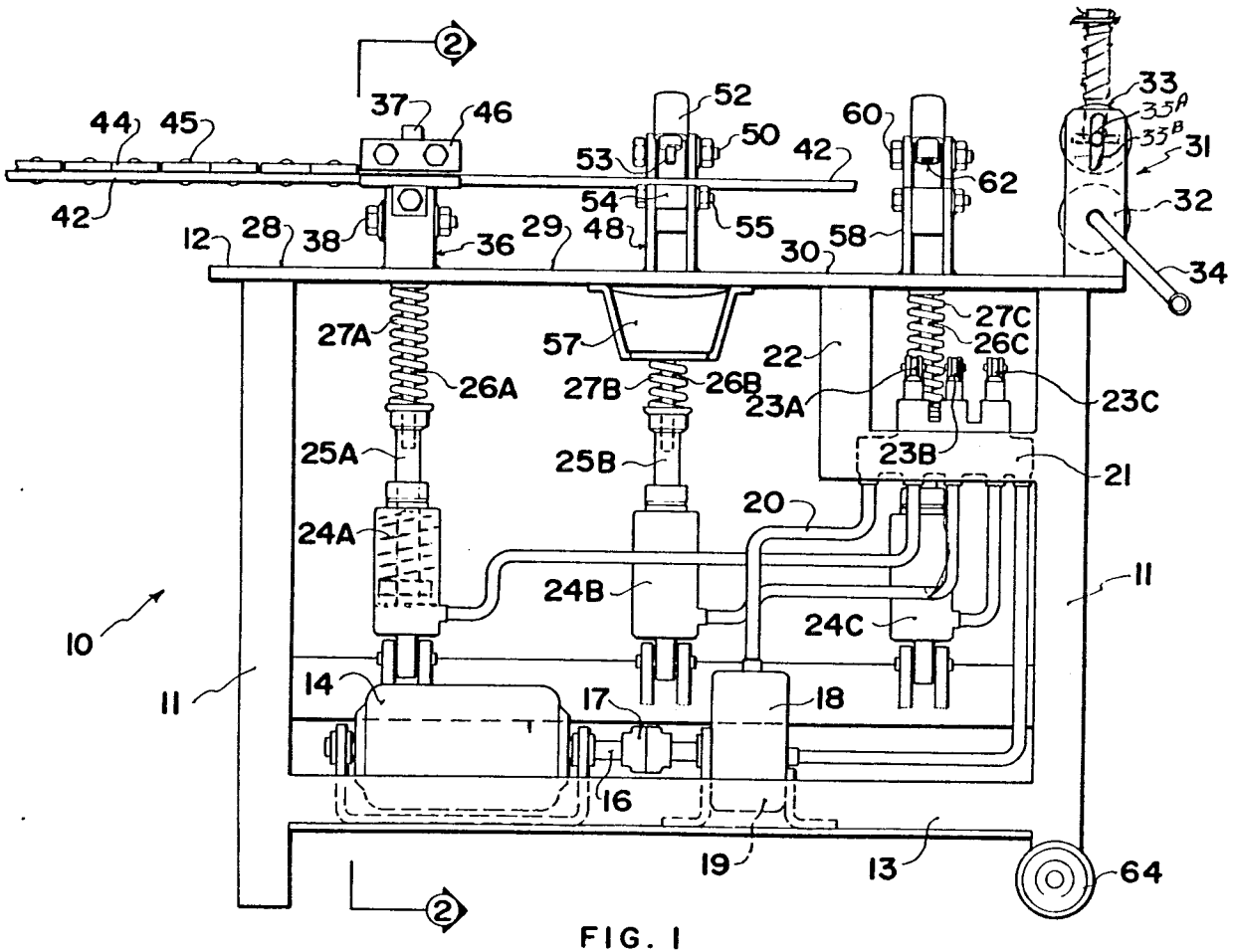
FIG. 1 is a front view of the assembly with the enclosing sides removed for clarity.
Figure 2:
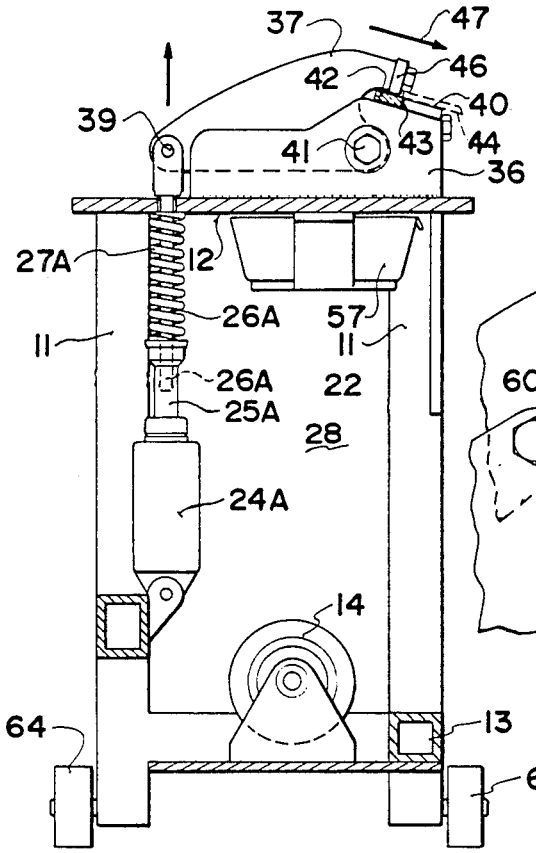
FIGS. 2 and 6 are fragmentary side elevations of the shearing device or station.
Figure 4:
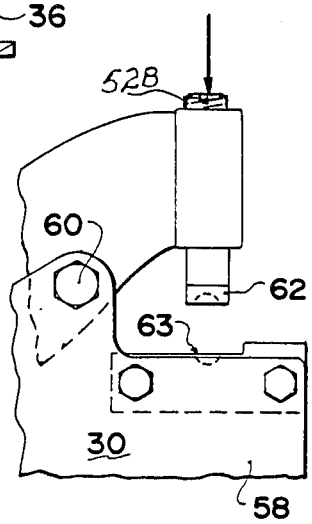
FIG. 4 is a fragmentary side elevation of the riveting device or station.

Proceeding therefore to describe the invention in detail, reference should first be made to FIG. 1 in which 10 indicates generally, a supporting framework comprising two pairs of vertical supports 11, a planar top 12 and a lower transverse bracing shelf 13. Normally, rectangular panels (not illustrated) are secured to the outer sides of the vertical supports 11 to enclose the framework or supporting frame which carries the operating mechanism below the top 12 and above shelf 13.

Such operating mechanism includes an electric motor 14 supported upon shelf 13 and operatively connected to a source of electrical energy and controlled by switch 15 which is situated externally at the side panel (not illustrated).

This motor drives shaft 16 and, via coupling 17, an hydraulic or pneumatic pump 18 together with the reservoir 19. This is known as an electro-hydropac package. Hoses 20 extend from the pump to a hydrualic or pneumatic three-spool control valve assembly 21 mounted between the vertical members 11 and hangers 22 depending from the underside of the upper plate 12.

Individual operating levers 23A, 23B and 23C extend from the individual spool valves and through the panel so that they can be operated externally and these spool valves connect to hydraulic or pneumatic piston and cylinder assemblies 24A, 24B and 24C respectively. Each of these piston and cylinder assemblies include a piston rod 25A, 25B and 25C having a vertically situated control rod 26A, 26B and 26C screw threadably engagable within the distal ends of the piston rods 25A, 25B and 25C respectively so that limited adjustment is provided to these control rods. Coil springs 27A, 27B and 27C extend around these control rods and react between the upper ends of the respective piston rods and the underside of the upper panel 12 normally urging the respective piston rods to the lower most or retracted positions within the cylinders.

Situated on the upper side of the horizontal or upper panel 12 are three stations, a shearing station 28, a rivet shank removal station 29 and a rivet heading station 30.

At one end of the upper panel 12 outboard of the rivet station 30, there is situated a twin roller assembly collectively designated 31. It consists of a pair of rollers 32 and 33 with the lower roller 32 being rotatable by means of hand crank 34. An annular groove 35 is formed in this lower roller, the purpose of which will hereinafter be described.

The upper roller shaft 33A is mounted in vertical slots 33B and is tensioned downwardly upon roller 32 by means of spring 33C on post 33D and reacting between a washer at the top of the post and a saddle spanning the ends of shaft 33A.

Situated at the first station at 28, is a shearing assembly comprising a swing plate frame 36 secured to the upper panel 12 and having a swing plate arm 37 pivoted to the frame intermediate the ends of the arm, by transverse pivot pin 38. The upper end of the control rod 26A is operatively connected to the rear end of arm 37 by means of cross pivot 39.

Figure 6:
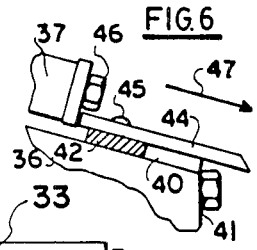
Figure 3:
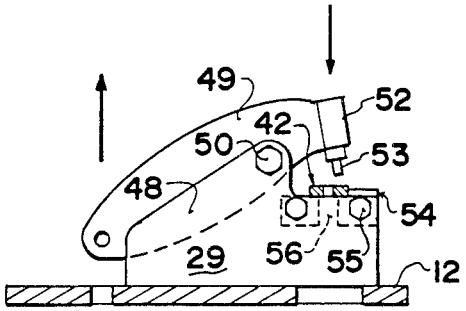
FIG. 3 is a fragmentary side elevation of the rivet shank removing device or station.
Figure 5:
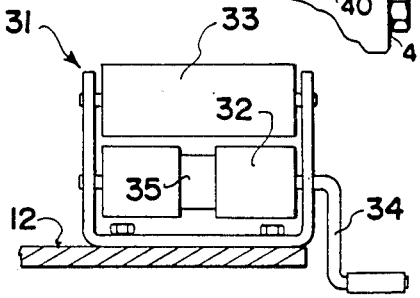
FIG. 5 is a fragmentary side elevation of the roller assembly.

A detachable anvil plate 40 is secured to the front of the swing plate frame 36 by means of cross bolt 41 and the rear side 43 of this anvil plate is raised above the portion of the frame 36 so that the knife bar 42 of a knife assembly, may rest against this rear edge when the knife bar is positioned within the assembly as shown in FIG. 1. The knife assembly includes the aforementioned bar 42, together with a plurality of conventional sickle knives 44 secured thereto by means of rivets 45. The rear edges of these knives extend slightly behind the rear edge of the bar 42 as shown in FIG. 6.

Situated on the front end of the sway plate arm 37 is a shear plate 46 which engages the rear edges of the knives moves transversely across the upper surface of the knife bar 42 when the piston and cylinder assembly 24A extends. The configuration of the arm 37 is such that this movement is substantially in the direction of arrows 47 so that with the bar being held against the rear edge 43 of the anvil 40, the knife is sheared from the bar due to the shearing of the rivets holding same to the bar.

The piston and cylinder assembly 24A is operated by the control lever 23A as hereinbefore described.

The section of the knife assembly is then moved to the next station 29 and in this connection reference should be made to the twin roller assembly 31. The knife assembly is engaged between this roller assembly and is frictionally held with the rectangular cross sectioned knife bar engaging the groove 35 in order to locate same in a fore and aft relationship with the three stations.

Rotation of the crank allows the individual knife 44 to be positioned firstly in the correct position within station 28 to allow the knife to be sheared from the bar. Further rotation of the crank 34 moves this portion of the bar to station 29 and the crank allows the accurate positioning of the portion within the station to permit the sheared rivets to be punched from the bar.

Station 29 also includes a sway plate frame 48 secured to the upper panel 12 and having a sway plate arm 49 pivoted intermediate the ends thereof to the frame by means of cross pivot pin 50.

It is operated by piston and cylinder assembly 24B via control shaft 26B which is pivotally secured to the rear of the arm 49 by means of cross pin 51.

Situated on the front end of the sway plate arm 49 is a rivet punch tool 52 having a rivet punch 53 extending therefrom.

A punch plate 54 is detachably secured to the front of the swing plate frame 48 by means of cross bolt 55 and this plate is apertured as at 56 and is in alignment with rivet punch 53.

The front of the swing plate frame is also vertically apertured and a container 57 is detachably secured under the upper panel 12 to receive and store the sheared rivets which are punched out at this station.

As mentined previously, the portion of the bar is positioned by means of the roller assembly 31 so that the punch 53 is in alignment with the sheared shank of the rivet being extracted whereupon lever 23B is actuated thus causing the punch 53 to descend and punch the rivet from the bar 42 whereupon this sheared rivet drops through aperture 56 and into the container 57 therebelow.

Once again the return spring 27B retracts the piston rod 25B and the control rod 26B to the lower most position so that the punch 53 is raised.

The knife bar assembly is then moved by the roller assembly 31 and crank 34 to station 30 which comprises a rivet heading tool assembly.

This assembly consists of a swing plate frame 58 secured to the upper plates 12 in a manner similar to the other assemblies.

A swing plate arm 59 is pivotally mounted within the support frame 58 by means of cross pivot pin 60 and the rear end of the arm 59 is operatively connected to the upper end of the control or operating rod 26C by means of cross pivot pin 61.

A cupped riveting tool 62 is detachably secured to the front end of the arm 59 and a cupped rivet header plate 63 is detachably secured to the front of the frame 58 immediately below the heading tool 62.

The portion of the bar to which a new knife is being secured is positioned accurately below the tool 62 with the new knife in position and the rivets engaged from the underside thereof so that the head is seated within the cupped plated 63.

Lever 23C is actuated thus causing the header tool 62 to descend and form the desired head upon the shank of the rivet thus securing the knife to the bar 42, it being understood that normally two such rivets are required.

Release of lever 23C enables spring 27C to return the piston rod 25C and the control bar 26C to the retracted position with the header tool in the raised position.

Alternatively, springs 27A, 27B and 27C may be eliminated and piston springs (shown in phantom at 27A) may be utilized within the cylinders 24A, 24B and 24C. Such return springs are conventional in hydraulic and pneumatic piston & cylinder assemblies.

It will therefore be appreciated that not only is the cutter bar assembly held firmly in position as the successive operations are performed but that the bar is easily positioned longitudinally by means of the crank 34 and the twin roller assembly 31. If necessary, the upper roller may be spring tensioned or adjustable so that the necessary frictional engagement of the cutter bar assembly, between the rollers 32 and 33, is obtained.

Finally, it should be noted that preferably, wheels 64 are provided upon one set of the end vertical members 11 thus enabling the other end to be lifted slightly so that the entire assembly can be moved as desired.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An assembly for removing and replacing sickle knives on a knife bar comprising in combination a supporting frame, first means on said frame to shear the rivets securing individual knives to said knife bar and to remove the knife therefrom, second means on said frame to punch out the rivet shanks from said knife bar remaining after said knife has been sheared therefrom, and third means on said frame to rivet new knives in position upon said frame, said first, second and third means operating successively upon individual knives being replaced, means to operate selectively, said first, second and third means and further means on said frame to position said knife bar successively relative to said first, second and third means.

2. The assembly according to claim 1 in which said further means comprises a manually operated twin roller assembly adjacent one end of said support frame, said knife bar engaging between said twin rollers and being frictionally engaged thereby, whereby rotation of said rollers moves said knife bar longitudinally relative to said first, second and third means.

3. The assembly according to claim 1 in which said first means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, shear plate means on the other end of said sway plate arm engageable with the rear side of said individual knife being removed, and means on said sway plate frame to detachably hold said knife bar in position whereby rocking movement of said sway plate arm by said means to operate selectively said first, second and third means, engages the rear side of said knife and moves it transversely relative to said knife bar thereby shearing the rivets holding said knife to said knife bar.

4. The assembly according to claim 2 in which said first means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, shear plate means on the other end of said sway plate arm engageable with the rear side of said individual knife being removed, and means on said sway plate frame to detachably hold said knife bar in position whereby rocking movement of said sway plate arm by said means to operate selectively said first, second and third means, engages the rear side of said knife and moves it transversely relative to said knife bar thereby shearing the rivets holding said knife to said knife bar.

5. The assembly according to claim 1 in which said second means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, rivet shank punch means on the other end of said sway plate arm engageable with the rivet shanks in said knife bar remaining after said knife has been removed by said shear plate means, to force said sheared rivets downwardly from said knife bar, and an apertured punch plate detachably secured within said sway plate frame with the aperture in alignment with said rivet shank punch means.

6. The assembly according to claim 2 in which said second means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, rivet shank punch means on the other end of said sway plate arm engageable with the rivet shanks in said knife bar remaining after said knife has been removed by said shear plate means, to force said sheared rivets downwardly from said knife bar, and an apertured punch plate detachably secured within said sway plate frame with the aperture in alignment with said rivet shank punch means.

7. The assembly according to claim 3 in which said second means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, rivet shank punch means on the other end of said sway plate arm engageable with the rivet shanks in said knife bar remaining after said knife has been removed by said shear plate means, to force said sheared rivets downwardly from said knife bar, and an apertured punch plate detachably secured within said sway plate frame with the aperture in alignment with said rivet shank punch means.

8. The assembly according to claim 4 in which said second means includes a sway plate frame secured to said supporting frame, a sway plate arm pivoted intermediate the ends thereof to said sway plate frame, for rocking movement about said pivot means, means operatively connected between one end of said arm and said means to operate selectively, said first, second and third means, rivet shank punch means on the other end of said sway plate arm engageable with the rivet shanks in said knife bar remaining after said knife has been removed by said shear plate means, to force said sheared rivets downwardly from said knife bar, and an apertured punch plate detachably secured within said sway plate frame with the aperture in alignment with said rivet shank punch means.

9. The assembly according to claim 1 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

10. The assembly according to claim 2 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

11. The assembly according to claim 3 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

12. The assembly according to claim 4 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

13. The assembly according to claim 5 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

14. The assembly according to claim 6 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

15. The assembly according to claim 7 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

16. The assembly according to claim 8 in which said third means includes a sway plate frame secured to said supporting frame, a sway plate arm pivoted intermediate the ends to said sway plate frame, for rocking movement about said pivot means, means operatively connected between one end of said arm and said means to operate selectively, said first, second and third means, a rivet tool detachably secured to the other end of said sway plate arm, a corresponding riveting tool plate detachably secured to said sway plate frame in vertical alignment with said riveting tool whereby rivets holding the replacement knife to said knife bar and positioned therebetween, may be headed thereby securing said knife to said knife bar.

17. The assembly according to claim 1 in which said means operating successively upon the individual knives being replaced include individual fluid operating piston and cylinder assemblies, one for each of said first, second and third means, means operatively connecting same selectively, to a source of fluid pressure, said piston and cylinder assemblies each including a piston rod, an actuating shaft adjustably secured by one end thereof to said piston rod and being operatively connected by the other end to said first, second or third means, and a return spring operatively connected between said piston rod and said support frame normally urging said piston rod to the retracted position.

18. The assembly according to claim 4 in which said means operating successively upon the individual knives being replaced include individual fluid operating piston and cylinder assemblies, one for each of said first, second and third means, means operatively connecting same selectively, to a source of fluid pressure, said piston and cylinder assemblies each including a piston rod, an actuating shaft adjustably secured by one end thereof to said piston rod and being operatively connected by the other end to said first, second or third means, and a return spring operatively connected between said piston rod and said support frame normally urging said piston rod to the retracted position.

19. The assembly according to claim 7 in which said means operating successively upon the individual knives being replaced include individual fluid operating piston and cylinder assemblies, one for each of said first, second and third means, means operatively connecting same selectively, to a source of fluid pressure, said piston and cylinder assemblies each including a piston rod, an actuating shaft adjustably secured by one end thereof to said piston rod and being operatively connected by the other end to said first, second or third means, and a return spring operatively connected between said piston rod and said support frame normally urging said piston rod to the retracted position.

20. The assembly according to claim 10 in which said means operating successively upon the individual knives being replaced include individual fluid operating piston and cylinder assemblies, one for each of said first, second and third means, means operatively connecting said selectively, to a source of fluid pressure, said piston and cylinder assemblies each including a piston rod, an actuating shaft adjustably secured by one end thereof to said piston rod and being operatively connected by the other end to said first, second or third means, and a return spring operatively connected between said piston rod and said support frame normally urging said piston rod to the retracted position.

* * * * *